United States Patent [19]

Woehr, Sr. et al.

[11] 4,015,733

[45] Apr. 5, 1977

[54] DEVICE FOR STORAGE OF MOTOR VEHICLES

[75] Inventors: Otto Woehr, Sr., Korntal; Wolfgang Woehr, Muenchingen, both of Germany

[73] Assignee: MPB Metall- and Parksystem-Bau GmbH, Korntal, Germany

[22] Filed: Jan. 29, 1975

[21] Appl. No.: 545,022

[30] Foreign Application Priority Data

Feb. 1, 1974 Germany ..... 2404833

[52] U.S. Cl. ..... 214/16.1 ED; 214/16.1 E

[51] Int. Cl.[2] ..... E04H 6/06

[58] Field of Search ..... 214/16.1 R, 16.1 ED, 214/16.1 E

[56] References Cited

UNITED STATES PATENTS

| | | | |
|---|---|---|---|
| 2,815,872 | 12/1957 | Graham | 214/16.1 ED |
| 3,146,903 | 9/1964 | Bjorklund | 214/394 |
| 3,741,412 | 6/1973 | Klaus | 214/16.1 ED |
| 3,750,808 | 8/1973 | Klaus | 214/16.1 ED |

FOREIGN PATENTS OR APPLICATIONS

| | | | |
|---|---|---|---|
| 1,124,411 | 7/1956 | France | 214/16.1 ED |

*Primary Examiner*—Robert J. Spar
*Assistant Examiner*—R. B. Johnson
*Attorney, Agent, or Firm*—Bacon & Thomas

[57] ABSTRACT

A device for storage of motor vehicles comprising at least two platforms arranged one above the other and being designed for vertical movement of the platforms to bring them into alignment with a single loading station at a given elevation and a linkage structure for tilting the loading edge of the lower platform(s) upward when being brought into alignment with the loading station.

12 Claims, 5 Drawing Figures

DEVICE FOR STORAGE OF MOTOR VEHICLES

BACKGROUND OF THE INVENTION

The present invention relates to a device for storage of motor vehicles, and more especially to a device for storing motor vehicles on at least two platforms, on top of one another, erected on the floor of an excavated pit having a single entrance level, raised with respect to the floor, for both platforms and being equipped with a mechanism for lifting or lowering the platforms to the common level of access.

Certain so-called "vertical parking devices" are in existence which consist of two or more platforms spaced vertically at a distance relative to one another which can be raised or lowered in a space between the bottom of an excavation and/or garage pit and upward to an access ramp common to both levels. In lowering such a device to the bottom position, the uppermost platform is held at a certain height above the common level of access and is then lowered on the entrance side to the level of the access ramp, whereby access is gained to the platform and to the vehicle resting on it. While this device affords certain savings in space when being built into garages or the like, it presents the disadvantage that the upper platform must be sloped relatively steeply in order to permit entry thereto, which presents certain difficulties in parking and entering, especially to elderly people. Moreover, the existing "vertical parking device", while requiring only a relatively shallow pit, possesses a relatively tall superstructure. While this feature is of minor importance in outdoor installations, it presents considerable disadvantages if the device is installed in underground garages where only a specific height between floors or a limited distance above the level of the entrance plane is available. It presents a serious problem when two-level garage facilities of this general type are to be installed serially in the basements of larger apartment or office buildings.

SUMMARY OF THE INVENTION

It is an object of the present invention to provide a device of the general type described above which has been modified in such a way that the tilting of the platforms at the entrance is either completely or largely eliminated.

It is a further object of the invention to provide a parking device wherein the overall height of the installation is reduced in comparison with existing devices.

In accomplishing the foregoing objects, there has been provided according to the present invention a device for storage of motor vehicles, comprising a frame member adapted for placement on a floor level located below an adjacent entrance plane for said motor vehicles; at least two generally horizontally oriented platforms arranged one above the other; means for maintaining said platforms in substantially parallel relationship; means for supporting said platforms on said frame member which permit rotation of said platforms about a horizontal axis and vertical movement of said platforms with respect to said frame member; means for raising and lowering said platforms simultaneously between a lower position wherein one end of the uppermost platform is positioned substantially level with and adjacent said entrance plane and an upper position wherein one end of the lowermost platform is positioned substantially level with and adjacent said entrance plane; and means responsive to movement between said lower and upper positions for orienting said uppermost platform substantially horizontal in said lower position and for orienting said lowermost platform in said upper position so that the end adjacent said entrance plane is higher than the opposite end of said lowermost platform.

In order to maintain an essentially level attitude of the platform in the loading position, with both platforms being parallel to one another, a somewhat deeper pit is required than that used in the existing equipment. By the present invention the overall height is reduced not merely through the greater depth of the pit but also by a slight slope in the two platforms at their upper terminal position, whereby the entrance ends are somewhat raised. To accomplish this, the lower platform, when in loading position, is sloped slightly downwards, a fact which does not present any difficulties in parking, since the angle of tilt can be of minimal size (a few degrees) and yet can result in a substantial reduction in overall height.

The tilt of the platforms is defined by lateral stops acting on at least one of the platforms and/or on the slide common to both.

One advantageous feature of the invention is the fact that the lower platform is bent at about the middle of its longitudinal axis with the vertex pointing upwardly and the segments tilting relative to each other at an angle between 3° and 5°. The bend in the platform is of advantage, but not absolutely necessary; it is helpful in rendering the adjustment of the platform to the loading level more gradual, at the same time allowing more space between the platforms when tilted, and in reducing the overall dimensions.

In an installation consisting of two or three tiers the platforms are held parallel to each other by jointed connecting bars. By parallelism is meant that both ends in the case of a bent lower platform are in contact with the floor of the garage pit. The platform is usually driven by hydraulic lifts installed at the platform edges and synchronized by steel cables and rollers, but other propulsion devices may be used.

Further objects, features and advantages of the invention will become apparent from the following detailed descriptions of several preferred embodiments of the invention, when considered together with the accompanying drawings.

DETAILED DESCRIPTION OF PREFERRED EMBODIMENTS

Figure 2:
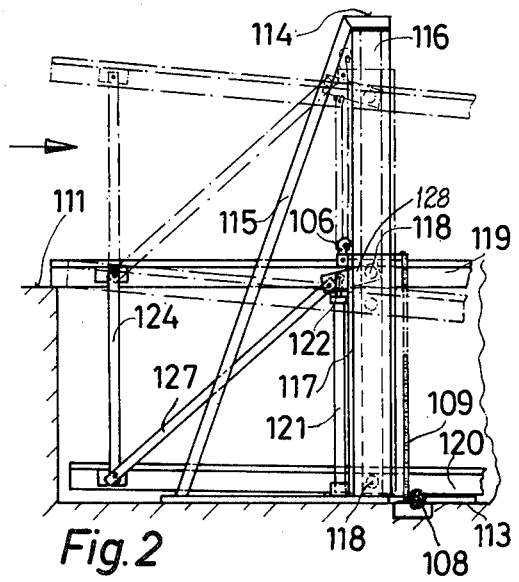
FIG. 2 is a partial view of a device similar to that in FIG. 1 having several modifications.
Figure 3:
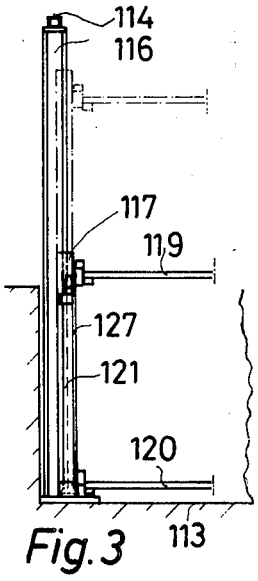
FIG. 3 is a partial frontal view of the device according to FIG. 2.
Figure 1:
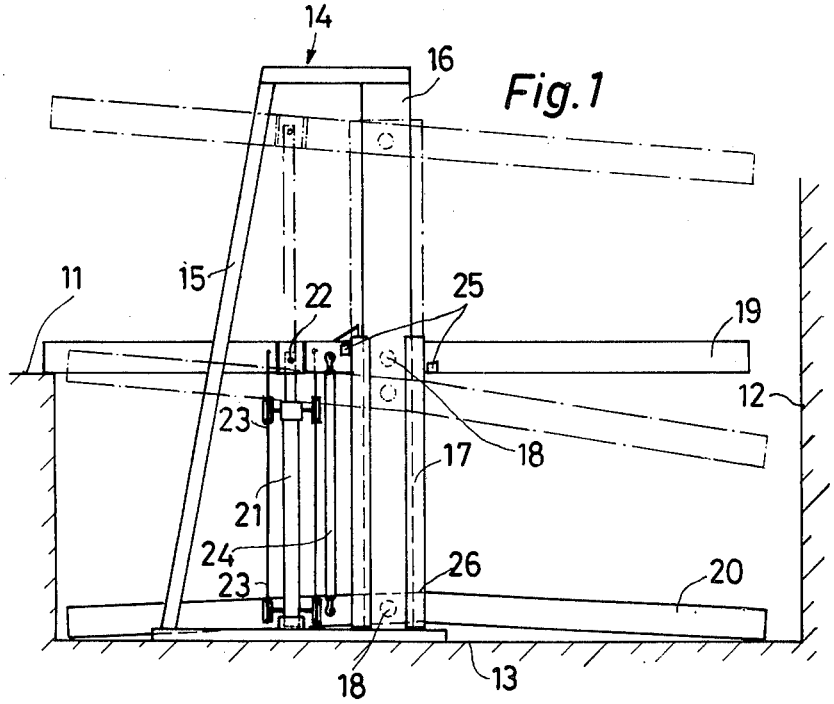
FIG. 1 is a schematic side view of the device according to the invention, having two platforms.
Figure 4:
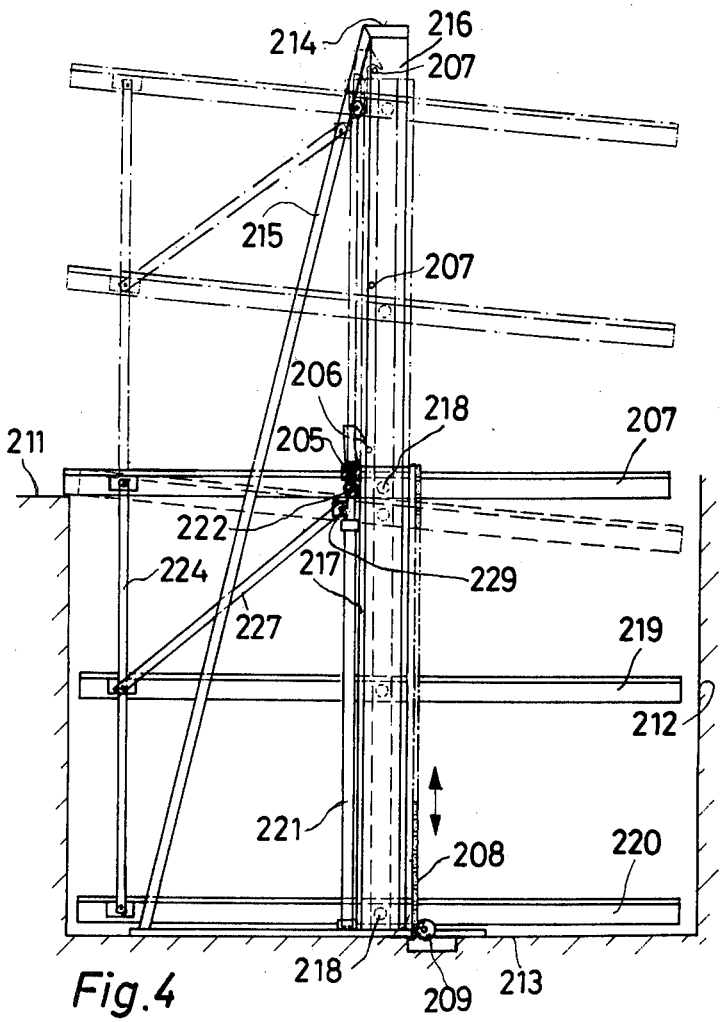
FIG. 4 is a schematic side view of a device having three platforms.

The design characteristics of the device according to FIGS. 1 to 3 may be applied in principle to a triple-tier setup with the garage pit deepened according to FIG. 4. According to FIG. 1, the device is constructed in a pit 10 which extends from a common approach plane 11 on one side to the building or cellar wall 12, for example, on the other side.

On the floor 13 of the garage pit rests frame 14, supported on both sides of the platform by at least one reinforcing strut 15 and a guide rail 16 serving as centerpost. The cross section of guide rail 16, along which a sliding rail 17 can be moved vertically, may correspond to that shown in FIG. 5. An upper platform 19 and a lower platform 20 are securely connected to sliding rail 17 by cross pins 18.

Both platforms, 19, 20, are shown in their lowered positions by solid lines and in their raised positions by broken lines. The lift is driven by hydraulic cylinders 21 jointed on both sides to the floor of the device, with the piston rods acting on the side of the upper platform on pin 22.

On the visible hydraulic cylinder 21 upper and lower cable guide rollers 23 are indicated over which cables run that terminate at one end in an attachment to the upper platform, and at the other end in an attachment to the lower platform, the cable passing under the lower platform. The objective is to equalize the lifting action of the cylinders. Other means of assuring the equalization of the lifts are possible. Both platforms 19, 20 are held parallel by connecting rods 24. Stops 25, attached to upper platform 19 per FIG. 1, serve to limit the tilt of the platform and are seated on the respective outer edges of slide 17. Whereas the upper platform is flat, the lower one, according to FIG. 1, may contain a bend 26, approximately in the middle of the platform, its vertex pointing upward. The bend is adapted to the anticipated wheel base and other dimensions of the vehicles to be parked on it.

In operating the device according to FIG. 1, a vehicle is driven onto the upper platform 19, whereupon the hydraulic lifts 21 raise both platforms to the extended upper position as indicated by broken lines. Simultaneously with the lifting motion, the end of the platform facing the approach swivels around pins 18, allowing the rear end of the platform to lower itself, or, as in the case of the lower platform, to make contact with the floor until stop 25 comes in contact with slide 17. Both platforms are subsequently raised and held in a tilted position. In the raised position access between loading ramp 11 and the lower platform 20 is established.

By the tilt of the platforms in raised position the overall height of the installation is reduced. Furthermore, the lower platform 20 in its loading position is tilted only slightly. Both platforms are held parallel to each other by connecting rods 24.

In the embodiment according to FIGS. 2 and 3 of the drawings, functionally corresponding components are numbered as in FIG. 1, but in the hundred series. In contrast to FIG. 1, connecting rods 124 are provided in FIGS. 2 and 3 on both sides of the platforms in the region of the entrance ramp 111. For the mutual reinforcement of both platforms 119, 120, lateral diagonal linking members 127 have been provided which are attached at one end to connecting rod 124 on lower platform 120, and at the other end, to tongue 128 which is attached to bearing pin 118 on platform 119.

When hydraulic lifts 121, with the ends of their piston rods 122 being joined to the upper platform 119, are activated, the entrance end of the upper platform is raised up. Simultaneously platform 119 raises lower platform 120 by means of the slide 117 running on guide rail 116 and by means of connecting rods 124. The tilt of both platforms 119, 120 during the lifting motion is controlled by the stroke of hydraulic cylinders 121 and by the length of the diagonal linking member 127 and tongue 128.

For the purpose of achieving absolute correspondence between the two hydraulic cylinders 121, a chain 109 has been installed vertically on both sides of frame 114 with sprockets 108 at the bottom of platform 120 placed at the ends of a shaft. The chain is held outside of the path of slide 117.

FIG. 4 represents a device according to the invention having three platforms 207, 219, 220, the uppermost platform 207 being level with connecting ramp 211 when the device is in its lower position. The design of this variant corresponds largely to that shown in FIGS. 2 and 3. The three platforms are coupled to one another near the entrance side by laterally placed connecting rods 224. Diagonal linking member 227, which is shaped as a fork at its upper end, connects the joint pin between platform 219 and connecting rod 224 with a bearing lug 229, by engaging its upper end laterally with a bearing lug 229 positioned laterally at the freely outstanding end of the piston rod. The upper ends of the piston rods of hydraulic lifts 221 are tapered and placed in a sleeve 205, attached to slide 217. This sleeve serves as a stop for segment of the piston rod holding the bearing lug 229. The rod propels slide 217 upwardly after tilting the vertical connecting rods 224 at the start of the lifting motion.

Figure 5:
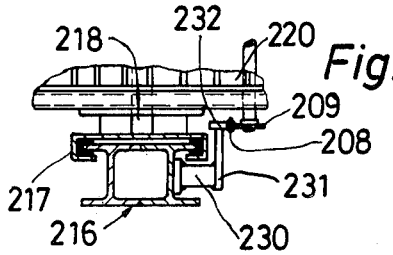
FIG. 5 is a cross sectional view of a columnar guide rail used in the device according to FIG. 4.

In FIG. 5 the sprocket wheels 209 are shown, serving as synchronizers. They are seated at the ends of a transverse shaft and engage with taut chain 208, rolling along in the direction of the double arrow P in FIG. 4. The chain stretches between the upper and lower holders 230, 231, 232, attached to the frame 214 and is out of the way of slide 217.

A hook, 105, (206, respectively) attached to the side of the upper platform drops by gravity into an arrest projection on the frame, presenting a safety catch in the event that the hydraulic lift fails. To lower the lift, this stop must be released by hand through an arrangement of levers and pulleys not shown. In the event of cylinder leakage it may be necessary to dismantle the hydraulic cylinder before the stops can released.

What is claimed is:

1. A device for storage of motor vehicles, comprising:

a. a frame member adapted for placement on a floor level located below an adjacent entrance plane for said motor vehicles, and including centrally positioned, vertically extending, telescopically arranged fixed and sliding rail means;

b. at least two generally horizontally oriented, separate platforms arranged one above the other;

c. Connecting rod means pivotally connected to said platform and extending generally vertically therebetween for maintaining said platforms in substantially parallel relationship;

d. pivot means pivotally connecting each of said platforms generally centrally thereof to said sliding rail means on said frame member, whereby to permit rotation of each of said platforms about a horizontal axis, said connecting rod means maintaining said platforms in substantially parallel relationship during such rotation;

e. raising and lowering means operatively connected between said frame member and said platforms for raising and lowering said platforms simultaneously between a lower position wherein one end of the uppermost platform is positioned substantially level with an adjacent said entrance plane, and an upper position wherein one end of the lowermost platform is positioned substantially level with and adjacent said entrance plane;

f. means for connecting said raising and lowering means to at least one of said platforms for causing tilting of both platforms simultaneously in substantially parallel relationship about their respective pivot means in cooperation with the connecting rod means when the raising and lowering means is actuated to raise the platforms towards their upper position, said lowermost platform having the end thereof adjacent said entrance plane higher than the opposite end of said lowermost platform when said lowermost platform is in its upper position;

g. means to limit the rotational movement of the platforms about their respective pivot means; and h. means engageable with at least one of said platform to cause said platforms to rotate back to a generally level position in their lowermost position.

2. The device as defined by claim 1, wherein said lowermost platform is provided with a bend along a horizontal axis at approximately the mid-point of its length, the vertex of said bend facing in the upward direction.

3. The device as defined by claim 2, wherein the angle of said bend is between about 3° and 5°.

4. The device as defined by claim 1, wherein said means to limit the rotational movement of the platforms is capable of permitting a tilt of said lowermost platform in the upper position of between about 3° and 5°.

5. The device as defined by claim 1, wherein said lowermost platform has both ends resting upon said floor in said lower position.

6. The device as defined in claim 1, wherein said connecting rod means are located near the ends of said platforms adjacent said entrance plane.

7. The device as defined by claim 1, wherein said raising and lowering means comprises a hydraulic lift system comprising at least one hydraulic piston having a piston rod.

8. The device as defined by claim 7, wherein said raising and lowering means further comprises sprockets on both sides of one platform, a shaft journaled in said platform to which said sprockets are attached, and two tautly stretched chains being arranged along the path of movement for said platform and being engaged respectively with said sprockets.

9. The device as defined by claim 7, wherein said lift system comprises one hydraulic piston on each side of said platforms, said pistons extending vertically from the base of said frame.

10. The device recited in claim 9, wherein said means to limit the rotational movement of the platforms comprises at least one lateral stop member attached to at least one of said platforms and being engageable with said rail means on said frame member.

11. The device as recited in claim 9, wherein said raising and lowering means is connected to said sliding rail means adjacent an upper platform of the storage device for causing raising of the platforms, and further wherein the said means for connecting said raising and lowering means to at least one of said platforms for causing tilting of both platforms simultaneously comprises a linking member connecting a movable part of said raising and lowering means to one end area of a platform lower than said upper platform.

12. The device as recited in claim 10 wherein the raising and lowering means is a hydraulic actuator centrally located adjacent to the sliding rail means, the actuator having a vertical movable member; a bearing lug member connected to the movable member of the actuator adjacent the uppermost platform; the linking member extending diagonally between and pivotally connected to one end area of the next lower platform beneath the uppermost platform and the bearing lug member; a stop sleeve attached to the sliding rail means; the movable member of the actuator extending through the sleeve above the point where the bearing lug member is attached thereto, the bearing lug contacting the stop sleeve and transmitting the raising force of the actuator to the slide rail when the actuator is energized to raise the platforms, the linking member being dimensioned so that it is shorter than the distance between its connecting point to the lower platform and the stop sleeve, whereby, when the actuator is energized to raise the platforms, the platforms are caused to tilt during their initial raising movement about their pivot means due to the movement of the movable member of the actuator until the bearing lug member contacts the stop sleeve.

* * * * *